US009938789B2

(12) United States Patent
Silva et al.

(10) Patent No.: US 9,938,789 B2
(45) Date of Patent: Apr. 10, 2018

(54) MOTION ACTIVATED BALL DROPPING TOOL

(71) Applicant: Baker Hughes Incorporated, Houston, TX (US)

(72) Inventors: Zachary S. Silva, Houston, TX (US); William B. Handy, Spring, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 312 days.

(21) Appl. No.: 14/694,350

(22) Filed: Apr. 23, 2015

(65) Prior Publication Data

US 2016/0312556 A1 Oct. 27, 2016

(51) Int. Cl.
*E21B 23/04* (2006.01)
*E21B 43/26* (2006.01)

(52) U.S. Cl.
CPC ..... *E21B 23/04* (2013.01); *E21B 43/26* (2013.01)

(58) Field of Classification Search
CPC ..... E21B 33/12; E21B 23/06; E21B 43/11; E21B 33/138; E21B 27/02; E21B 41/00
USPC ..... 124/26
See application file for complete search history.

(56) References Cited

U.S. PATENT DOCUMENTS 3,981,189 A * 9/1976 Howard ..... E21B 43/24 166/264
4,660,638 A 4/1987 Yates, Jr.
5,020,609 A 6/1991 Jeter
5,343,963 A 9/1994 Bouldin et al.
5,842,149 A 11/1998 Harrell et al.
6,386,288 B1 5/2002 Snider et al.
7,165,612 B2 1/2007 McLaughlin
2004/0011533 A1* 1/2004 Lawrence ..... E21B 23/01 166/382
2004/0129430 A1* 7/2004 Tessier ..... E21B 17/06 166/378
2010/0126718 A1* 5/2010 Lilley ..... E21B 47/0005 166/253.1
2011/0209867 A1* 9/2011 Nevels ..... E21B 41/00 166/181

(Continued)

OTHER PUBLICATIONS

Schatz, J.F., et al., "High-Speed Downhole Memory Recorder and Software Used to Design and Confirm Perforating/Propellant Behavior and Formation Fracturing," SPE 56434, Oct. 1999, 1-9.

(Continued)

*Primary Examiner* — Robert E Fuller
*Assistant Examiner* — Steven A MacDonald
(74) *Attorney, Agent, or Firm* — Steven Rosenblatt

(57) ABSTRACT

A ball is retained behind a circular array of collet fingers to be pushed out through the collets with a spring biased piston that is initially locked when run in the hole. The lock mechanism is a link that holds a potential force in the main spring. One end of the link is held by an acceleration or deceleration responsive retainer. The retainer has a conforming stop surface to a stop surface on the link. Sudden relative movement caused by acceleration of the housing allows the retainer that is flanked by opposed springs to move away from the stop surface or surfaces on the link. The link is an array of spaced fingers that can radially flex. The radial flexing combines with the power of the main spring to propel the piston against the ball for a release of the ball. A fracturing operation then ensues.

23 Claims, 3 Drawing Sheets

(56) References Cited

U.S. PATENT DOCUMENTS

| | | | |
|---|---|---|---|
| 2013/0020065 | A1 | 1/2013 | Tubel et al. |
| 2013/0024030 | A1 | 1/2013 | Tubel et al. |
| 2013/0175053 | A1 | 7/2013 | Madero et al. |

OTHER PUBLICATIONS

Shatz, J.F., et al., "High-Speed Pressure and Accelerometer Measurements Characterize Dynamic Behavior During Perforating Events in Deepwater Gulf of Mexico," SPE 90042, Sep. 2004, 1-15.
Zannoni, S.A., et al., "Development and Filed Testing of a New Downhole MWD Drillstring Dynamics Sensor," SPE 26341, 1993, 269-283.
Rewcastle, S.C., et al., Real-Time Downhole Shock Measurements Increase Drilling Efficiency and Improve MWD Reliability, IADC/SPE 23890, 1992, 433-442.

* cited by examiner

MOTION ACTIVATED BALL DROPPING TOOL

FIELD OF THE INVENTION

The field of the invention is devices that drop objects to land on other tools in support of borehole completion operations and more particularly in a preferred embodiment a bottom hole assembly component that releases a ball onto a seat of a frack plug to facilitate fracturing operations.

BACKGROUND OF THE INVENTION

Fracturing involves sequential isolation of part of a borehole so that a perforating gun can initiate fractures followed by delivery of pressure to the fractures to open them up further before production begins. Typically a plug is at a lower end of a bottom hole assembly (BHA) and the perforating gun is above. The plug is set and the gun is released and fired. The plug can have a passage through it with a surrounding ball seat. Before the fracturing starts a ball is landed on the seat and pressure is built up to open the fractures made by the perforating gun.

One way to expedite this process is to have the housing for the ball as part of the BHA to cut down the time and some uncertainty of dropping a ball from the surface to the seat in the frack plug before the pressure pumping operations can take place. To also save time in these operations the BHA is run in on wireline and delivered to the desired location with the aid of pumped fluid for the reason that often the desired location is in a long horizontal run.

In typical plug and perforate systems the bottom hole assembly (BHA) comprises an isolation device with a passage through it and a surrounding seat on the passage for an object to land on the seat and obstruct the passage. The object can be delivered with the isolation device or pumped to the isolation device after the perforating guns are shot and removed from the borehole with the setting tool for the isolation device. Delivering the object with the isolation device has the advantage of saving time to get the passage in the isolation device closed as compared to pumping down an object from the surface. However, this prior method has a drawback if the guns misfire. In essence, if the guns misfire they must be removed and new guns run in to the desired location which is frequently in a horizontal portion of the wellbore. Thus, gravity is not much help in running in the replacement guns. Furthermore, if the object was run in with the isolation device, then the object would be forced against the seat in the passage of the isolation device if any effort to use pressure or flow to deliver the replacement guns was employed. The closing off of the passage in the isolation device means the replacement guns cannot be delivered on wireline with a pressure or flow assist and that alternative means such as coiled tubing or tractors have to be used to get the guns into position. This adds enormous expense to the operation and creates issues of delay. Even if the object is dropped after the misfired gun is removed, it still takes time to pump the object from the surface to the seat on the isolation device that is thousands of meters away costing time and additional fluid displacement.

In the past one way to cut the time to get an object seated on a seat in an isolation device was to include a ball release device above the guns. The idea in US 2013/0175053 was to release the object into the annulus from above the fired gun and have the object make its way around the fired gun and the isolation device setting tool to a seat on a passage in the isolation device. A physical pull on the wireline sheared an unnumbered pin and allowed a ball 24 to escape through a lateral opening 28 to make its way toward the isolation device 14. There are many issues with this design. Frequently the guns 18 have very low clearance around them to the casing 12, which means the ball 24 will not fit in the annular space or would have to be so small that the passage in the isolation device 14 would also have to be small. A smaller passage in the isolation device could mean delays if a replacement gun has to be delivered with flow after an original gun misfires, as well as reduced flow-through rates that would limit a wells ability to flow back and produce through the isolation device in the event of sanding out. The spent perforating gun could also have burrs and sharp edges that could hang up or damage the object so badly that it might not seal at all when landing in the seat. Finally, in a horizontal run the object may not actually land on the seat if the seat surrounding the passage in the isolation device is considerably smaller than the casing inside diameter, a condition made necessary by the object being small enough to travel past the gun in the surrounding annulus around the gun.

Generally related to operation of lateral passages that can be selectively opened in a fracking context are US2013/0024030 and US2013/0020065.

In an application entitled Pressure Actuated Frack Ball Releasing Tool filed in the US on Mar. 10, 2014, with a Ser. No. 14/202,974, the pressure wave generated by the firing of the gun was sensed and a ball release mechanism was triggered to release the ball onto the seat of the adjacent frack plug. This device required sensors for sensing the pressure wave and then actuation of an independent hydraulic circuit to actually launch the ball.

Another phenomenon that occurs when the gun is fired is that there is a sudden acceleration of the string followed by a deceleration in an oscillatory movement back and forth until another steady state is reached. The present invention capitalizes on this movement pattern to release a potential energy force that propels the object and in the case of a fracking operation allows the ball to reach the seat of the frack plug to plug off the passage through the plug so that pressure can be built up and the fractures initiated with the perforating gun can be further propagated.

U.S. Pat. No. 5,020,609 illustrates a compensation system to offset acceleration forces in an unrelated context that uses a mass in tandem with opposed springs.

The preferred embodiment of present invention capitalizes on the relative movement created during acceleration to release a lock on a potential energy source to launch an object to another tool in furtherance of the fracturing operation. Other applications are envisioned where a gun is fired that creates string acceleration or in other contexts where acceleration or deceleration creates relative movement that can be harnessed to operate a tool. These and other aspects of the present invention will be more readily apparent to those skilled in the art from a review of the description of the preferred embodiment and the associated drawing, while recognizing that the full scope of the invention is to be determined by the appended claims.

SUMMARY OF THE INVENTION

A ball is retained behind a circular array of collet fingers or equivalent structures such as detents, dogs, split ring, shear screws, shear wire, etc. to be pushed out through the collets or equivalents with a spring biased piston that is initially locked when run in the hole. The lock mechanism is a link that holds a potential force in the main spring. One end of the link is held by an acceleration or deceleration responsive retainer. The retainer has a conforming stop surface to a stop surface on the link. Sudden relative movement caused by acceleration of the housing allows the retainer that is flanked by opposed springs to move away from the stop surface or surfaces on the link. The link is an array of spaced fingers that can radially flex. The radial flexing combines with the power of the main spring to propel the piston against the ball for a release of the ball. A fracturing operation then ensues.

DETAILED DESCRIPTION OF THE PREFERRED EMBODIMENT

Figure 1:
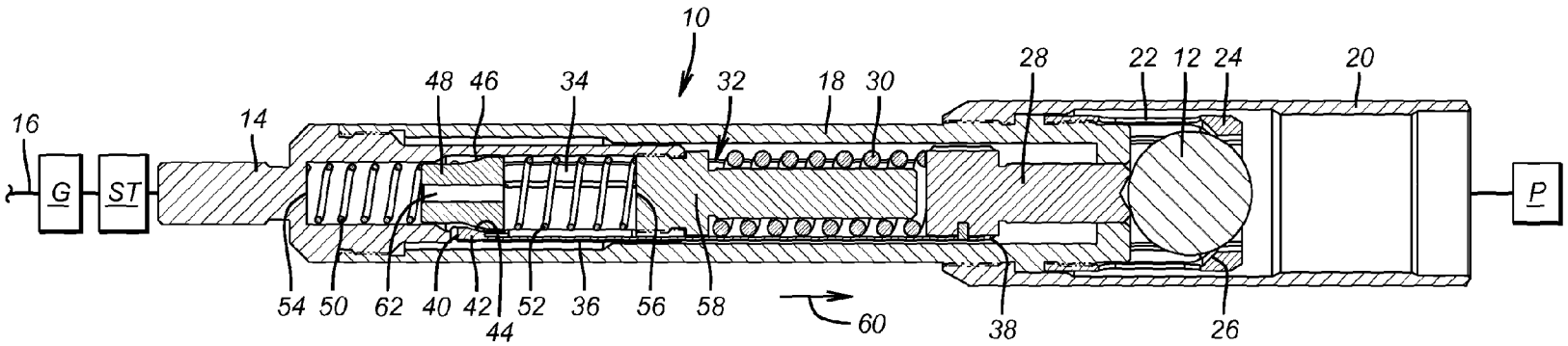
FIG. 1 is a section view of the apparatus in the run in position.
Figure 1A:
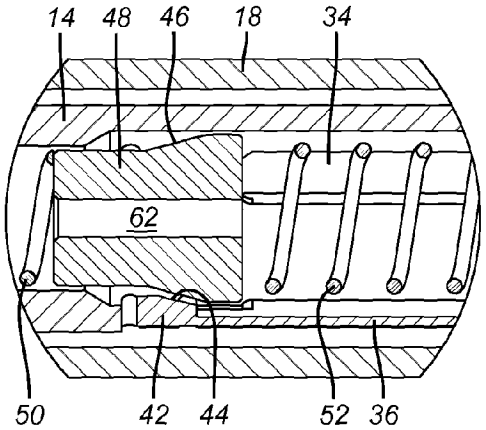
FIG. 1*a* is a detailed view of the shuttle position in the run in position of FIG. 1.

Referring to the FIGS. 1 and 1*a*, the tool 10 is part of a bottom hole assembly (BHA) that is not shown. In a fracturing context where the object is to release a ball 12 after setting off a perforating gun that is not shown, the outer housing comprises a top sub 14 below a perforating gun G and a frack plug setting tool ST with the BHA supported on a wireline 16. The frack plug P is initially supported below the tool 10. The top sub 14 is connected to the body 18 which is in turn connected to the lower sub 20. An array of collet fingers 22 having enlarged heads 24 create a retaining seat 26 for the ball 12 during running in. Piston 28 is run in under pressure from compressed spring 30 which is the power spring that will ultimately move the piston 28 to push the ball 12 past seat 26 as the fingers 22 with heads 24 flex radially outwardly.

Figure 2A:
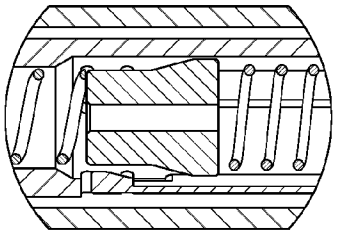
FIG. 2*a* is a detail of the position of the shuttle in FIG. 2.
Figure 3A:
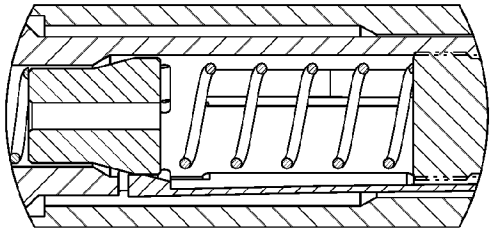
FIG. 3*a* is a detailed view of the shuttle position in FIG. 3.
Figure 4A:
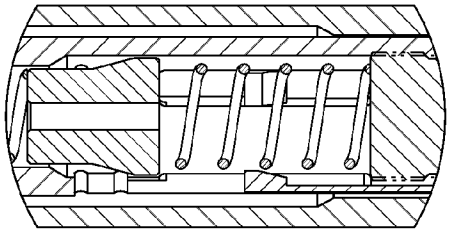
FIG. 4*a* is the view of the shuttle in detail as shown in FIG. 4.
Figure 2:
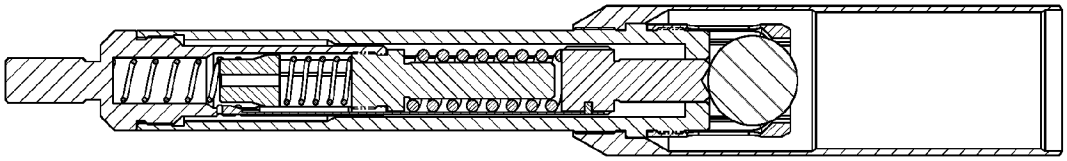
FIG. 2 is the view of FIG. 1 showing the shuttle position when initial acceleration is stopped.
Figure 3:
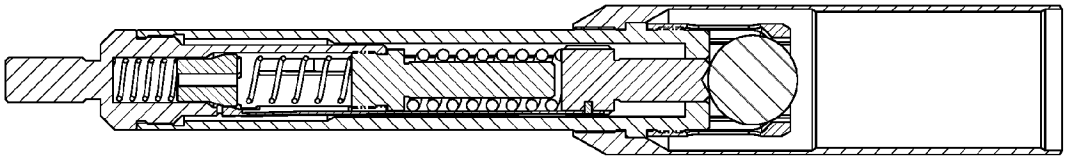
FIG. 3 is the view of FIG. 2 after the shuttle rebounds to release the piston that pushes out the ball.
Figure 4:
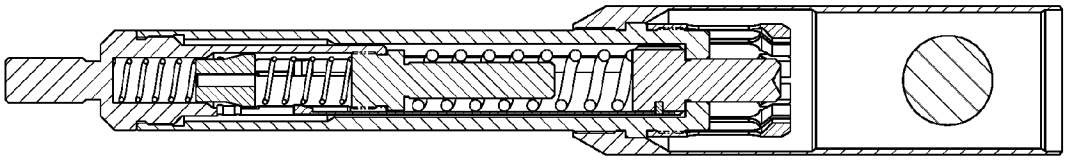
FIG. 4 is the view of FIG. 3 showing the piston pushing out the ball past the ball detent.

What holds the power spring 30 in the compressed state for running in is link assembly 32 which comprises a number of elongated equally spaced members of which two 34 and 36 are shown. Each of the members of the link assembly 32 are affixed to the piston 28 at the lower ends 38 of the members of the link assembly 32. At the upper ends 40 there are heads 42 with tapered surfaces 44 that conform to a tapered surface 46 on shuttle or retainer 48. Shuttle 48 has opposed springs 50 and 52 with spring 50 supported off of surface 54 and spring 52 being supported off of surface 56 on power spring guide 58. Guide 58 is secured to top sub 14 and extends through spring 30 on an opposite end thereof. The link assembly is held in place, while restraining the spring, by a bearing surface in top sub 14. When surfaces 44 and 46 are engaged the link assembly is retained against axial movement in the direction of arrow 60. However, if there is a sudden acceleration, as in FIGS. 2 and 2*a*, followed by deceleration as would occur when gun G is fired there is an oscillation of the shuttle 48 opposed by springs 50 and 52, as shown in FIGS. 3 and 3*a*, that separates the shuttle 48 and its surface 46 away from surface 44 on heads 42 and rebounds shuttle 48 to impact surface 44 and flex link assembly 32 radially outward so that the power of power spring 30 accelerates the combination of the link assembly 32 with the piston 28 against the ball 12 to release the ball 12 past the retaining seat 26, as shown in FIGS. 4 and 4*a*, and onto a seat that is not shown in the frack plug P. Shuttle 48 may compress springs 50 or 52 fully against surfaces 54 or 56 respectively when oscillating back and forth in response to sudden acceleration and deceleration of the tool 10 that would have been earlier released from the plug P during the setting of plug P which occurs before the gun G is fired.

Those skilled in the art will appreciate that the design is relatively simple and in the preferred embodiment is purely mechanical, which makes it economical to build and reliable in operation. While coiled springs are illustrated other types of mechanical or fluid springs can be used such as Belleville washers or variable volume chambers of compressible gas. The lock mechanism can be configured in a variety of ways with the initiated relative movement from gun firing being the lock release. Shuttle 48 has a through passage 62 through which fluid can flow in a direction opposed to the movement of the shuttle 48 to allow the shuttle 48 to oscillate longitudinally or radially in the housing without getting into a fluid lock. The ball 12 can be retained by other devices such as shear pins or split rings that can spread open. Other tools can be actuated either directly by movement of the piston 28 or indirectly by the movement of the piston 28 resulting in release of an object such as a ball to land on another tool or by the piston operating a setting mechanism or otherwise triggering movement or enabling a reaction that builds pressure or completing an actuation circuit, for example and not by way of limitation. The applications can cover various types of treatment methods that encompass but are not limited to, hydraulic fracturing, stimulation, tracer injection, cleaning, acidizing, steam injection, water flooding, cementing, etc.

Figure 5:
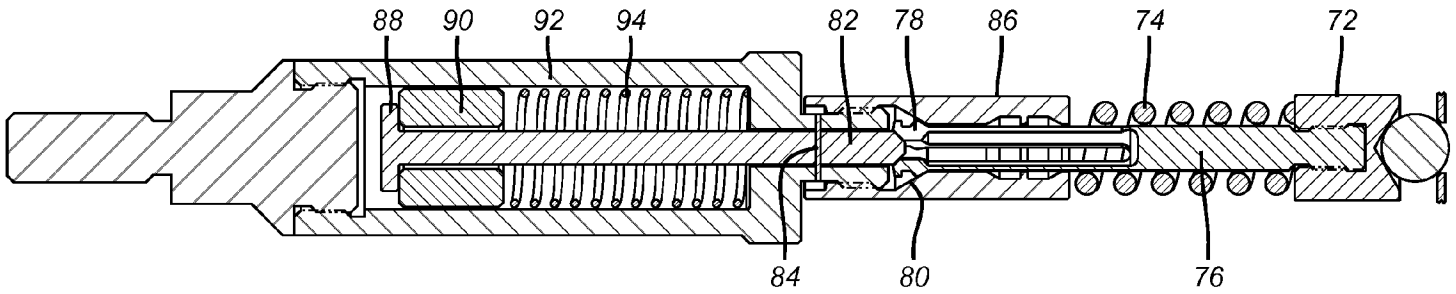
FIG. 5 is a section view of an alternative embodiment in the run in position.
Figure 6:
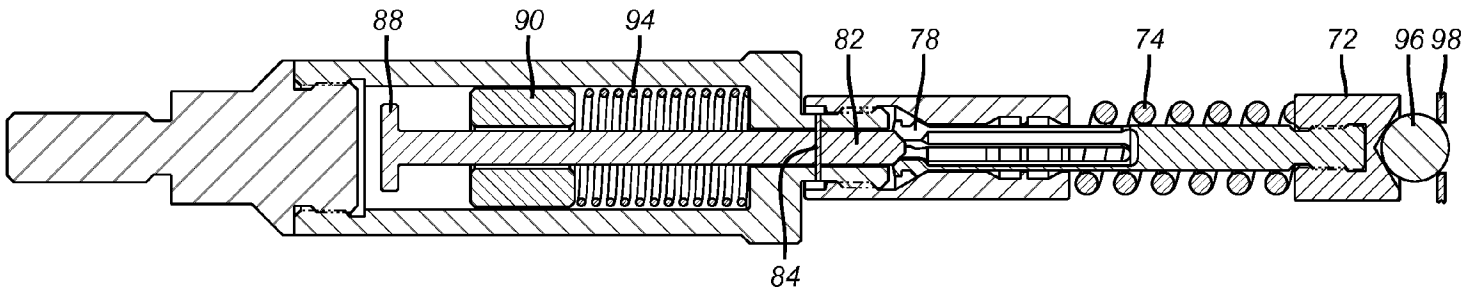
FIG. 6 is the view of FIG. 5 with acceleration stopped and weight movement compressing a spring.
Figure 7:
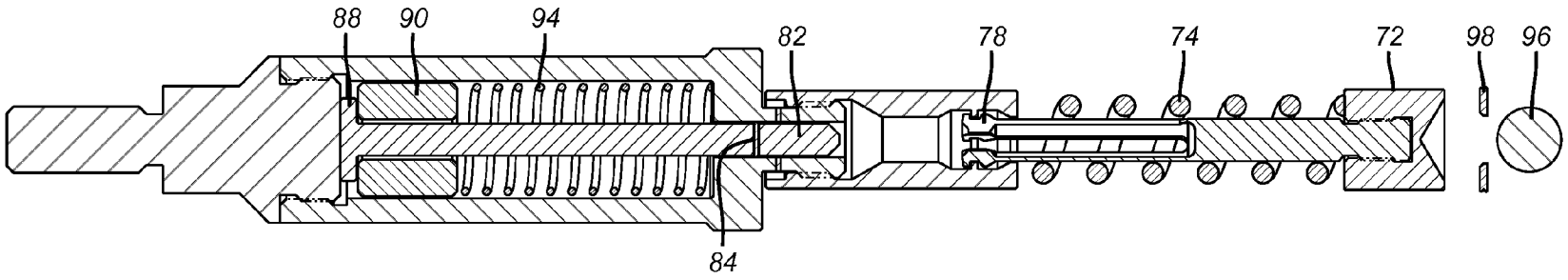
FIG. 7 is the view of FIG. 6 with the compressed spring relaxing to push the weight against a retaining member that breaks free to allow another spring to launch an object.

FIG. 5 illustrates an alternative embodiment where the piston 72 is biased by a spring 74 and is retained by a retainer 76 that passes through the coils of the spring 74. Heads 78 are initially held against taper 80 by a locking or retaining rod 82 whose initial position is secured by a shearable or breakable member 84 secured to lower housing 86. Locking rod 82 has an anvil 88 near the opposite end from the shearable member 84. A shuttle 90 surrounds rod 82 in upper housing 92. A spring 94 biases the shuttle 90. Upon rapid acceleration that is then reduced, as shown in FIG. 6, the shuttle 90 compresses spring 94 before reversing direction as spring 94 propels the shuttle 90 against the anvil 88 to shear the retainer 84 and then to pull away rod 82 from heads 78 which allows spring 74 to propel piston 72 to push ball 96 past retainer 98, as shown in FIG. 7. Thus the main difference in this embodiment in the mode of operation is that a retaining member is sheared instead of being allowed to radially flex to effect the launching of the object.

The above description is illustrative of the preferred embodiment and many modifications may be made by those skilled in the art without departing from the invention whose scope is to be determined from the literal and equivalent scope of the claims below:

We claim:

1. A releasable lock assembly for use with a subterranean tool, comprising: a housing further comprising a potential energy force selectively contained by a lock assembly; a retainer in said housing responsive to acceleration followed by deceleration of said housing to release said lock assembly thereby allowing release of said potential energy force which initiates movement of an actuating member relative to said housing for operation of the subterranean tool.

2. The assembly of claim 1, wherein:

said retainer is movably mounted in said housing for opposed movement in said housing.

3. The assembly of claim 2, wherein:

said opposed movement is at least one of longitudinally or radially in said housing.

4. The assembly of claim 1, wherein:

said retainer is biased in opposed directions.

5. The assembly of claim 4, wherein:

said biasing in opposed directions comprises opposed springs.

6. The assembly of claim 5, wherein:

said springs comprise at least one from a group comprising coil springs, Belleville washers, compressible gas in a variable volume chamber.

7. The assembly of claim 1, wherein:

said retainer overcoming said bias in opposed directions in response to acceleration or deceleration of said housing.

8. The assembly of claim 1, wherein:

said retainer having a passage therethrough.

9. A subterranean treating method involving a subterranean tool employing the lock assembly of claim 1.

10. The method of claim 9, wherein:

said treating method comprising at least one of hydraulic fracturing, stimulation, tracer injection, cleaning, acidizing, steam injection, water flooding and cementing.

11. The assembly of claim 1, wherein:

said retainer is biased in one direction.

12. The assembly of claim 11, wherein:

said bias in one direction is selectively retained by a breakable member.

13. The assembly of claim 12, wherein:

said retainer comprises a slidably mounted shuttle to a retaining rod, said shuttle biased by said bias in said single direction toward an anvil adjacent an end of said retaining rod, whereupon deceleration after acceleration said shuttle is propelled against said anvil with sufficient force to break said breakable member.

14. A releasable lock assembly for use with a subterranean tool, comprising:

a housing further comprising a potential energy force selectively contained by a lock assembly;

a retainer in said housing responsive to acceleration or deceleration of said housing to release said lock assembly thereby allowing release of said potential energy force which initiates relative movement of an actuating member mounted to said housing for operation of the subterranean tool;

said assembly further comprises a perforating gun whose firing creates said acceleration and deceleration of said housing.

15. A releasable lock assembly for use with a subterranean tool, comprising:

a housing further comprising a potential energy force selectively contained by a lock assembly;

a retainer in said housing responsive to acceleration or deceleration of said housing to release said lock assembly thereby allowing release of said potential energy force which initiates relative movement of an actuating member mounted to said housing for operation of the subterranean tool;

said actuating member comprising a piston, said piston selectively retained to said retainer with at least one elongated member.

16. The assembly of claim 15, wherein:

movement of said retainer relative to said elongated member allows release of said potential energy force against said piston.

17. The assembly of claim 16, wherein:

movement of said retainer allows an upper end of said elongated member to flex radially away from said retainer under power of a power spring that had previously held said potential energy force.

18. The assembly of claim 17, wherein:

said power spring axially drives said piston after said movement of said retainer.

19. The assembly of claim 18, wherein:

said piston pushes a ball past a ball retainer to release said ball to land on a frack plug.

20. The assembly of claim 19, wherein:

said ball retainer comprises a plurality of fingers in a circular array with heads forming a support for said ball.

21. The assembly of claim 19, wherein:

said retainer having a passage therethrough.

22. The assembly of claim 15, wherein:

said at least one elongated member comprises a plurality of circumferentially spaced elongated members.

23. A subterranean treating method involving a subterranean tool with a releasable lock, comprising:

providing a housing further comprising a potential energy force selectively contained by a lock assembly;

providing a retainer in said housing responsive to acceleration or deceleration of said housing to release said lock assembly thereby allowing release of said potential energy force which initiates relative movement of an actuating member mounted to said housing for operation of the subterranean tool;

providing a plug as the subterranean tool;

pressure pumping against said plug and into a surrounding formation.

* * * * *